US010246854B2

(12) United States Patent
Greer

(10) Patent No.: US 10,246,854 B2
(45) Date of Patent: Apr. 2, 2019

(54) MATERIAL HANDLING MACHINE WITH RIDE CONTROL SYSTEM AND METHOD

(71) Applicant: Aaron Greer, Germantown, WI (US)

(72) Inventor: Aaron Greer, Germantown, WI (US)

(73) Assignee: Wacker Neuson Production Americas LLC, Menomonee Falls, WI (US)

( * ) Notice: Subject to any disclaimer, the term of this patent is extended or adjusted under 35 U.S.C. 154(b) by 204 days.

(21) Appl. No.: 15/335,390

(22) Filed: Oct. 26, 2016

(65) Prior Publication Data

US 2018/0112375 A1 Apr. 26, 2018

(51) Int. Cl.

| | |
|---|---|
| ***E02F 9/22*** | (2006.01) |
| ***E02F 9/20*** | (2006.01) |
| ***E02F 3/34*** | (2006.01) |
| *F15B 21/00* | (2006.01) |

(52) U.S. Cl.

CPC ..... *E02F 9/2058* (2013.01); *E02F 3/3414* (2013.01); *E02F 9/2217* (2013.01); *E02F 9/2225* (2013.01); *E02F 9/2267* (2013.01); *E02F 9/2004* (2013.01); *F15B 21/008* (2013.01); *F15B 2211/8613* (2013.01)

(58) Field of Classification Search

CPC ..... F15B 2211/8613; F15B 2211/8616; E02F 9/2207

See application file for complete search history.

(56) References Cited

U.S. PATENT DOCUMENTS

| | | | | |
|---|---|---|---|---|
| 4,953,723 | A * | 9/1990 | Saotome | B60G 17/017 212/261 |
| 4,969,562 | A | 11/1990 | Saotome | |
| 5,195,864 | A | 3/1993 | Drake et al. | |
| 5,520,499 | A | 5/1996 | Ufheil et al. | |
| 5,706,657 | A | 1/1998 | Amborski et al. | |
| 5,733,095 | A | 3/1998 | Palmer et al. | |
| 5,992,146 | A | 11/1999 | Hausman | |
| 6,167,701 | B1 | 1/2001 | Hatcher et al. | |
| 6,260,355 | B1 | 7/2001 | Rausch et al. | |
| 6,321,534 | B1 | 11/2001 | A'Hearn et al. | |
| 6,357,230 | B1 | 3/2002 | A'Hearn et al. | |
| 6,398,227 | B1 | 6/2002 | Lech et al. | |
| 6,634,653 | B2 | 10/2003 | Chatterjea | |
| 7,194,856 | B2 | 3/2007 | Ma et al. | |
| 7,530,434 | B2 | 5/2009 | Bitter | |
| 7,621,124 | B2 | 11/2009 | Mizoguchi et al. | |

(Continued)

*Primary Examiner* — F Daniel Lopez

(57) ABSTRACT

A material handling machine such a skid-steer loader includes an electrohydraulic control system for controlling flow between a boom lift cylinder, an accumulator, and a source of pressurized fluid that delivers a variable system pressure. The electrohydraulic control system is switchable between a standard or normal mode and a ride control mode. It is configured to charge the accumulator with fluid from the pressurized fluid source while isolating the accumulator from the lift cylinder during operation in the standard mode and is configured to isolate the accumulator from the pressurized fluid source and to couple the accumulator to the lift cylinder during operation in the ride control mode. The accumulator is charged to a maximum pressure output by the source of pressurized fluid during the standard operating mode and pressure-balanced with the lift cylinder prior to initiation of operation in the ride control mode.

18 Claims, 8 Drawing Sheets

(56) References Cited

U.S. PATENT DOCUMENTS

| | | | | |
|---|---|---|---|---|
| 9,091,039 | B2 | 7/2015 | Dobchuk et al. | |
| 2012/0251283 | A1 | 10/2012 | Violland et al. | |
| 2014/0144130 | A1* | 5/2014 | Vigholm ..... | E02F 9/2207 60/327 |
| 2014/0238007 | A1 | 8/2014 | Payne | |

* cited by examiner

MATERIAL HANDLING MACHINE WITH RIDE CONTROL SYSTEM AND METHOD

BACKGROUND OF THE INVENTION

1. Field of the Invention

The invention relates to material handling machines such as skid-steer loaders or bucket loaders and, more particularly, relates to a material handling machine incorporating a ride control system and method for reducing shocks to the machine's load carrier during machine travel.

2. Discussion of the Related Art

Material handling machines such as forklifts, skid-steer loaders, wheel loaders, track loaders, telehandlers, and excavators often are equipped with load carriers for transporting loads from location to location. Such load carriers include forks, platforms, and buckets. The loads may comprise pallets or other objects that can be transported by a fork or platform or may comprise soil, sand, gravel, or other materials that can be transported by a bucket. The load carriers of many of these machines are mounted on one or more booms that can be raised and lowered relative to a platform or frame of the machine via one or more hydraulic lift cylinders.

One problem that has been observed while operating a material handling machine having a load carrier is that the weight of the loaded carrier causes the entire load carrier and associated components such as lift booms to lope or bounce up and down as the machine is driven over rough or uneven terrain. This is due primarily to the large moment of inertia of the load and of the loader across a comparatively short wheelbase.

Systems have been developed to counteract this tendency to lope or bounce. Such systems often include an accumulator which is selectively connected to the machine's lift cylinder to essentially utilize the lift cylinder as a suspension system. Because the accumulator cushions and absorbs energy from the movement of the load and permits the lift cylinder to extend and retract while the machine as a whole bounces over rough terrain, the lift ride becomes substantially less bouncy. These systems typically are called "ride control system."

Typical ride control systems work reasonably well but exhibit drawbacks and disadvantages.

For example, most ride control systems require a complex system of valves to initially charge the accumulator and to maintain the pressure in the accumulator during a ride control mode of operation and/or to prevent undesired cylinder extension or retraction when switching between modes or when operating in the ride control mode. This complexity undesirably adds to the costs of initially assembling and of maintaining these machines. Since the control valves typically are solenoid-activated, this complexity also undesirably adds to the electrical load handling requirements of the machines. Some of these systems require one or more pressure transducers in the machine, adding still more cost and complexity to the machine. These sensors and other features adding to the complexity of the machine also are prone to failure, undesirably reducing the machine's robustness.

The need therefore has arisen to provide a ride control system and/or method for a material handling machine that effectively reduces load carrier bouncing during travel over rough or uneven terrain but that is relatively simple and robust when compared to prior ride control systems and methods.

SUMMARY OF THE INVENTION

In accordance with a first aspect of the invention, one or more of the above-identified needs is met by providing a material handling machine having a mobile chassis, a boom that is raiseable and lowerable relative to the chassis, a load carrier that is mounted on the boom, a lift cylinder that is connected to the boom, a source of pressurized fluid that delivers a variable system pressure, an accumulator, and an electrohydraulic control system for controlling fluid flow between the lift cylinder, the accumulator, and the source of pressurized fluid. The electrohydraulic control system is configured to be switchable between a standard or normal mode of operation and a ride control mode of operation. It is configured to charge the accumulator with fluid from the pressurized fluid source while isolating the accumulator from the lift cylinder during the standard mode of operation. In the ride control mode, the electrohydraulic control system is configured to isolate the accumulator from the pressurized fluid source and to couple the accumulator to the lift cylinder.

The accumulator may be coupled to the pressurized fluid source via a valve of the electrohydraulic control system that is open during operation of the machine in the standard mode so as to result in charging of the accumulator to the maximum system pressure experienced during operation in the standard mode. The valve may be a solenoid activated valve that prevents fluid flow to the cylinder from the pressurized fluid source when it is activated.

When switching from the standard mode to the ride control mode, the electrohydraulic control system may additionally be operable in a transitional mode in which the hydraulic pressure in the accumulator is equalized with a then-prevailing hydraulic pressure in the lift cylinder.

The electrohydraulic control system may include a manually actuated ride control command generator that, upon activation thereof, causes the electrohydraulic control system to switch from the standard mode to the ride control mode.

Also provided is a method of effecting ride control of a material handling machine configured at least generally as described above.

Various other features, embodiments and alternatives of the present invention will be made apparent from the following detailed description taken together with the drawings. It should be understood, however, that the detailed description and specific examples, while indicating preferred embodiments of the invention, are given by way of illustration and not limitation. Many changes and modifications could be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENT

Figure 1:
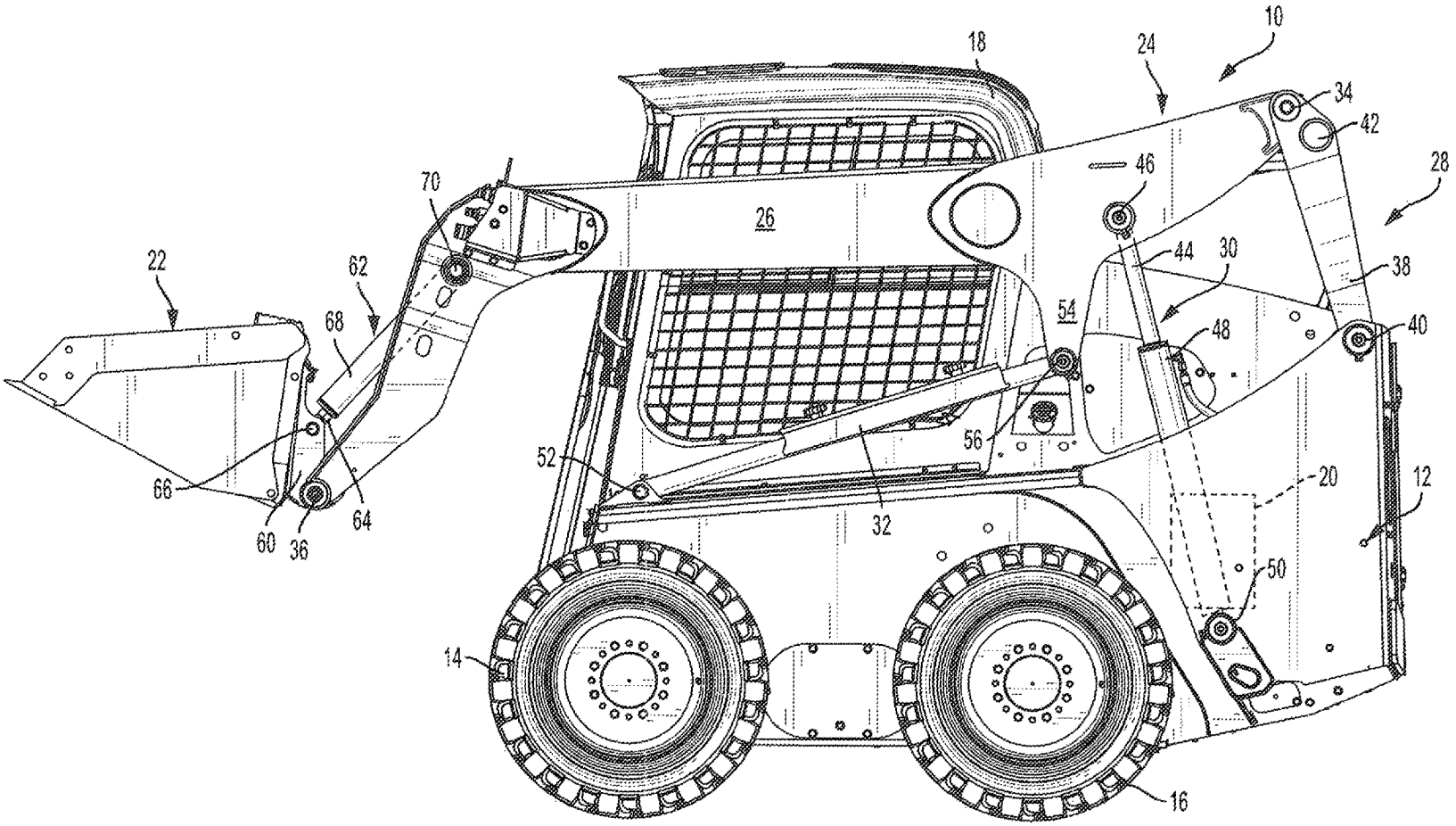
FIG. 1 is a side elevation view of a material handling machine in the form of a skid-steer loader incorporating a ride control system constructed in accordance with an embodiment of the present invention.

Referring to the drawings and initially to FIG. 1, a material handling machine 10 is illustrated that is fitted with a ride control system constructed in accordance with the present invention. The illustrated machine 10 is a skid-steer loader having a vertical lift arrangement. However, the concepts discussed herein apply equally to a skid-steer loader having a radial lift arrangement, as well as to a variety of other material handling machines that are equipped with a platform, fork, bucket, or other liftable load carrier. Such machines include, but are not limited to, forklifts, wheel loaders, track loaders, telehandlers, backhoes, and excavators.

The illustrated machine 10 includes a chassis or frame 12 movably supported on the ground via wheels 14 and 16. The frame 12 supports an operator's cab 18, an engine 20, and all electronic and hydraulic control systems required to propel the machine 10 and to control its powered devices. The frame 12 may be stationary relative to wheels 14 and 16 or may be a platform that is mounted on a subframe so as to rotate about a vertical axis relative to the subframe to permit repositioning of the booms 26 (described below) relative to the subframe. Located within the cab 18 are a seat and controls (not shown) for operating all components of machine 10. These controls typically include, but are no way limited to, a steering wheel, a throttle, and one or more pedals, levers, joysticks, or switches.

Still referring to FIG. 1, a bucket 22 is mounted on the frame 12 so as to be liftable and tiltable relative to the frame 12. The bucket 22 also can be lifted relative to the frame 12 via a pair of opposed booms assemblies 24, only the left one of which is illustrated. Each boom assembly 24 is identical, consisting of a boom 26, a boom support assembly 28, a lift cylinder 30, and a link 32. The illustrated left boom 26 has a rear end that is pivotally attached to the boom support assembly 28 by a pivot pin 34. Boom 26 also has a front end that receives an associated side of the bucket via a pivot pin 36. The boom support assembly 28 includes first and second laterally spaced stationary arms 38 which flank the rear end of the boom 26 and only one of which is shown in FIG. 1. Each arm 38 has a bottom end affixed to the frame 12 at a location 40 and a top end receiving the pivot pin 34 for the boom 26. The boom support assemblies 28 on the opposed sides of machine 12 are linked by a stationary horizontal support tube 42.

Still referring to FIG. 1, the lift cylinder 30 is a double acting hydraulic cylinder that includes a rod end 44 and a barrel end 48. Rod end 44 is pivotally affixed to the boom 26 forwardly of the boom's rear end via a first pivot pin 46. Barrel end 48 is pivotally attached to the frame 12 forwardly of the boom support assembly 28 via a second pivot pin 50. The link 32 is located in front of the lift cylinder 30. Link 32 has a front end affixed to the frame 12 via a first pivot pin 52 and a rear end affixed to an ear mount 54 on the boom 26 forwardly of the lift cylinder 30 via a second pivot pin 56. Due to this construction, extension and retraction of the lift cylinders 30 raises and lowers each of the booms 26 about its rear end, with the links 32 constraining boom movement to more purely vertical movement than otherwise would be possible.

Still referring to FIG. 1, the bucket 22 bears left and right rear support plates (only the left plate 60 being illustrated) supporting the bucket 22 on the booms 26 for tilting movement. The bottom of the illustrated left support plate 60 is pivotally mounted on the front end of the boom 26 by the pin 36. The bucket 22 can be tilted relative to the booms 26 and thus relative to the frame 12 via a pair of left and right opposed double acting hydraulic tilt cylinders 62. As can be appreciated from viewing the left tilt cylinder 62 of FIG. 1, each tilt cylinder has a lower rod end 64 and an upper barrel end 68. The rod, end 64 is pivotally attached to the associated bucket support plate 60 via a first pivot pin 66 located above the bottom pivot pin 36. The barrel end 68 is pivotally attached to the associated boom 26 via a second pivot pin 70. As a result of this construction, extension and retraction of the bucket tilt cylinders 62 drives the bucket 22 to tilt up and down about a horizontal axis defined by the pivot pins 36.

As mentioned above, manually operated controllers are located in the cab 18 to control boom lift and bucket tilt. In one embodiment, these controllers are integrated into a single two axis joystick 80 in FIG. 2 that can be moved along a first axis, such as fore-and-aft, to raise and lower the booms 26 and about a second axis, such as side-to-side, to tilt the bucket 22 relative the booms 26. A ride control command generator also is provided for activating the ride control system. The ride control command generator could be operated automatically in response to designated operating conditions, such as some combination of machine travel speed, load on the load carrier, and/or sensed bounce. In this particular embodiment, the ride control command generator is a manually operated device. The device could be, for example, a switch such as a trigger, a push-button switch, or a toggle-switch located at any of a number of locations in the cab 18. The illustrated device takes the form of a switch 82 that comprises a momentary switch mounted on the joystick 80. Switch 82 is configured to trigger activation of the ride control system when actuated a first time and to trigger deactivation of the ride control system when actuated a second time. Other switches 84 and 86 may be mounted on the joystick 80 for controlling other aspects of machine operation, such as a bucket tilt control system and an auxiliary device 88.

Figure 2:
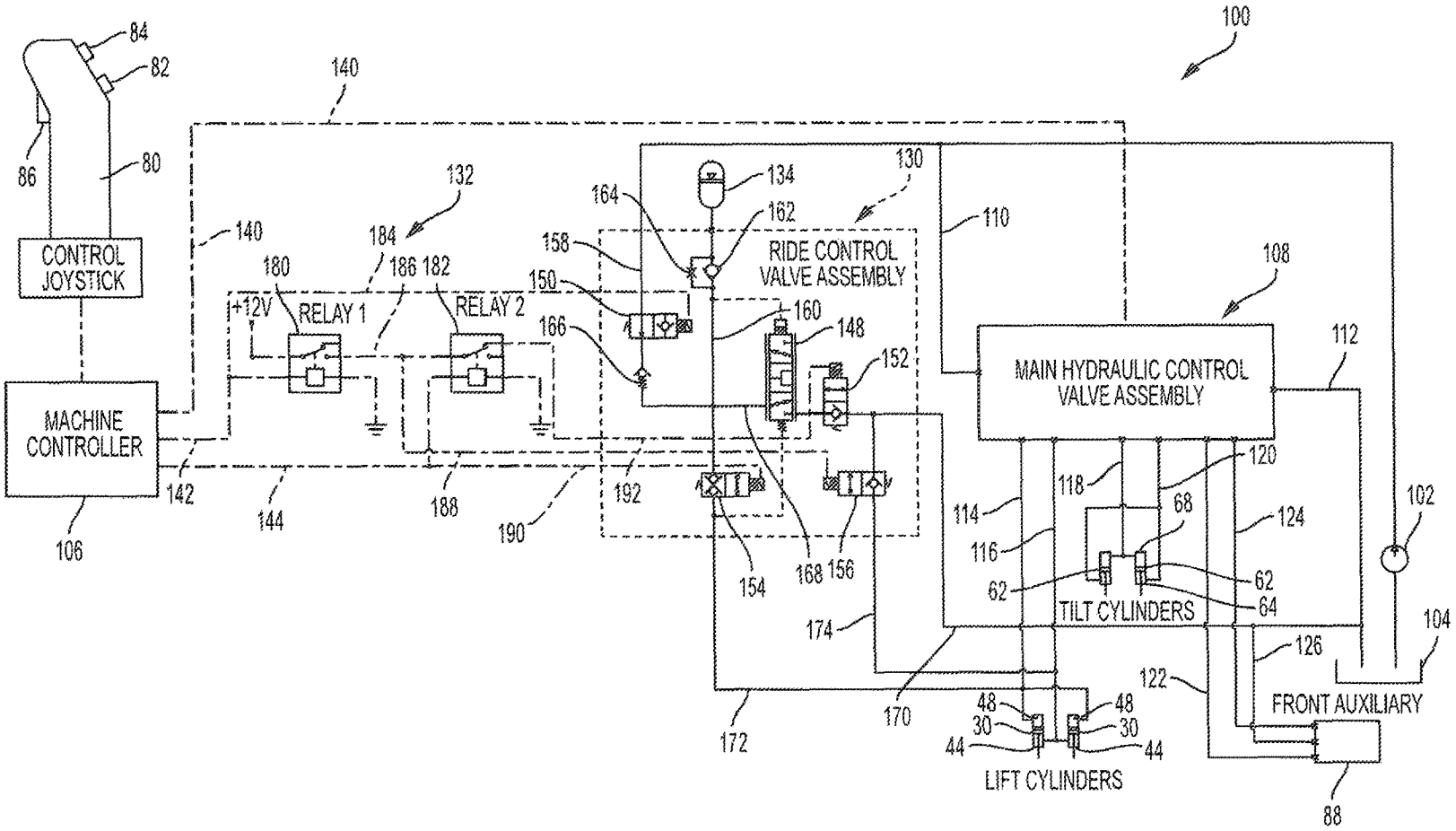
FIGS. 2-4 schematically illustrate the ride control system fitted on the machine of FIG. 1 with the system configured to operate in a standard mode, a transitional mode, and a ride control mode, respectively.

Still referring to FIG. 2, boom and bucket operation are controlled by an electrohydraulic control system 100 that controls operation of the lift cylinders 30, the tilt cylinders 62, and an auxiliary device 88 such as an auger, bale spears, etc. More specifically, the electrohydraulic control system 100 includes a pressurized fluid source 102, a reservoir or tank 104, an ECU or machine controller 106, and a main hydraulic control valve assembly 108. The pressurized fluid source 102 may be a fixed displacement or variable displacement pump receiving hydraulic fluid from the reservoir 104. The illustrated pump is a fixed displacement pump in the form of a gear pump driven by the machine's engine 20. The effective output pressure of the pump or "system pressure" is variable due to the actuation of the main hydraulic control valve assembly 108 to control the hydraulically actuated components of the machine 10. The main hydraulic control valve assembly 108 is fluidically connected to the pump outlet and the reservoir 104 by respective supply and return lines 110 and 112. Valve assembly 108 also is connected to the barrel end 48 of each of the lift cylinders 30 via a first line 114 and to the rod end 44 of each of the lift cylinders 30 via a second line 116. Valve assembly 108 also is connected to the barrel end 68 of each of the tilt cylinders 62 via a third line 118 and to the rod end 64 of each of the tilt cylinders 62 via a fourth line 120. Finally, fifth and sixth lines 122 and 124 control fluid flow to and from the auxiliary 130, which is also connected to the reservoir 104 by a line 126. All of the lines 114-124 permit bi-directional flow therethrough in dependence on the activation state of the main hydraulic control valve assembly 108. Electronically activated valves within valve assembly 108 receive control signals via one or signal lines, one of which is shown at 140.

Still referring to FIG. 2, the electrohydraulic control system 100 additionally comprises a ride control system including a ride control valve assembly 130 and associated electronic controls 132. The ride control system is configured to effect ride control using an accumulator 134 to absorb shocks on the system by exchanging fluid with the lift cylinders 30. The electronic controls 132 are electronically coupled to the joystick 80 and the electronic controller 106 via signal lines 142 and 144. Ride control valve assembly 130 is electrically coupled to the electronic controls 132 and is fluidically coupled to the accumulator 134, the reservoir 104, the pump 102, the lift cylinders 30, and a lift cylinder control valve assembly contained within the main hydraulic control valve assembly 108. The lift cylinder control valve assembly includes a pressure modulating valve 148 that is shown as being located within the ride control valve assembly 130 for the sake of convenience. The electronic controller 106 is configured to cause the electronic controls 132 to control the ride control valve assembly 130 to fluidically couple the accumulator 134 to the pump 102 to charge the accumulator 134 during the standard mode of system operation and to fluidically isolate the accumulator 134 from the pump 102 and to fluidically couple the accumulator 134 to the lift cylinders 30 during the ride control mode of system operation.

Toward this end, the ride control valve assembly 134 includes a cut-off valve 150, a pressure balancing valve 152, and first and second activation valves 154 and 156, all of which are two-way/two position solenoid activated valves that are activated by the electronic controller 106. Cut-off valve 150 is a normally open valve located in a high pressure supply line 158 coupled to the outlet of the pump 102 Line 158 opens into an accumulator supply/return line 160 that is coupled to the accumulator 134 via a check valve 162 and a flow restrictor 164 located in parallel with one another. In the open or deactivated position of valve 150 shown in FIG. 2, fluid can flow freely through the valve 150 from the pump 102 to the accumulator 134. As shown, valve 150 is technically a check valve in that, in the activated position shown in FIGS. 3 and 4, an internal check in the valve 150 permits reverse fluid flow toward the pump 102 but prevents flow through the valve from the pump 102. Nevertheless, fluid flow through the valve 150 to the accumulator 134 and other downstream system components from the pump 102 is "cut off" at this time by the internal check. Other valves disclosed herein, including valves 152 and 156, are illustrated as having corresponding internal checks which, as understood by those skilled in the art, function the same as the check within valve 150. Another check valve 166 is located in line 158 downstream of the cut-off valve 150 to prevent reverse fluid flow through the valve 150 when the valve 150 is open. With this arrangement, the accumulator 134 is charged during standard system operation due to fluid flow into the accumulator 134 from the valves 150 and 166, lines 158 and 160, and the restrictor 164. The accumulator 134 is isolated from the pump outlet 102 when the valve 150 is closed or activated.

Still referring to FIG. 2, a line 168 leads from the accumulator supply/return line 160 to a drain line 170 emptying into the reservoir 104. The pressure modulating valve 148 and the balancing valve 152 are located in the line 168. Balancing valve 152 is a normally closed solenoid activated valve which, when open, connects an outlet of the pressure modulating valve 148 to the reservoir 104 via the return line 170. The pressure modulating valve 148 is a pilot actuated valve which, when its outlet is coupled to the reservoir 104 via the valve 152, is responsive to fluid pressure in the accumulator supply/return line 160 and a lift cylinder supply/return line 172 (discussed below) to permit fluid to flow though the valves 148 and 152 and to the reservoir 104 so long as the fluid pressure in the accumulator supply/return line 160 exceeds the fluid pressure in the lift cylinder supply/return line 172. This conditional flow leads to pressure balancing or pressure equalization between the accumulator 134 and the barrel ends 48 of the lift cylinders 30 by equalizing, the pressure in the line 160 with pressure in the line 172.

Still referring to FIG. 2, the activation valves 154 and 156 connect the barrel ends 48 and the rod ends 44, respectively, of the lift cylinders 30 to the ride control valve assembly 130. Activation valve 154 is a normally closed solenoid activated valve which is located in the lift cylinder supply/return line 172. Activation of valve connects the line 172 to the line 160 to permit free fluid flow between the barrel ends 48 of the lift cylinders 30 and the accumulator 134. Activation valve 156 is a normally closed solenoid activated valve which is located in a line 174 connecting the drain line 170 to the rod ends 44 of the lift cylinders 30. Activation of valve 156 connects the line 174 to the drain line 170 to drain fluid from the rod ends 44 of the lift cylinders 30 to the reservoir 104. Valve 156 thus can be considered a rod end drain valve.

The valves 150, 152, 154, and 156 are controlled by selective energization of the signal lines 142 and 144, which can be considered a balancing line and an activation line, respectively, for reasons that will become apparent below. Balancing line 142 is coupled to a normally open relay 180, and activation line 144 is coupled to a normally closed relay 182. An outlet line 186 connects relays 180 and 182. A line 188, coupled to the outlet line 186 upstream of relay 182, is coupled to the coil for the valve 156 so that the valve 156 is energized whenever the relay 180 is energized. The solenoid of cut-off valve 150 is directly connected to balancing line 142 via a branch line 184 that bypasses the relay 180. Similarly, the solenoid of valve 154 is directly coupled to the activation line 144 by a branch 190 of line that bypasses the relay 182. This direct connection enables monitoring of the status of the coils of the valves 150 and 154 by the controller 106. The outlet of relay 182 is coupled to the solenoid of valve 152 via a line 192. Due to this arrangement, energization of relay 182 via energization of activation line 144 electrically isolates the line 192 from the line 186 to deenergize the solenoid of balancing valve 152 and close that valve.

Figure 3:
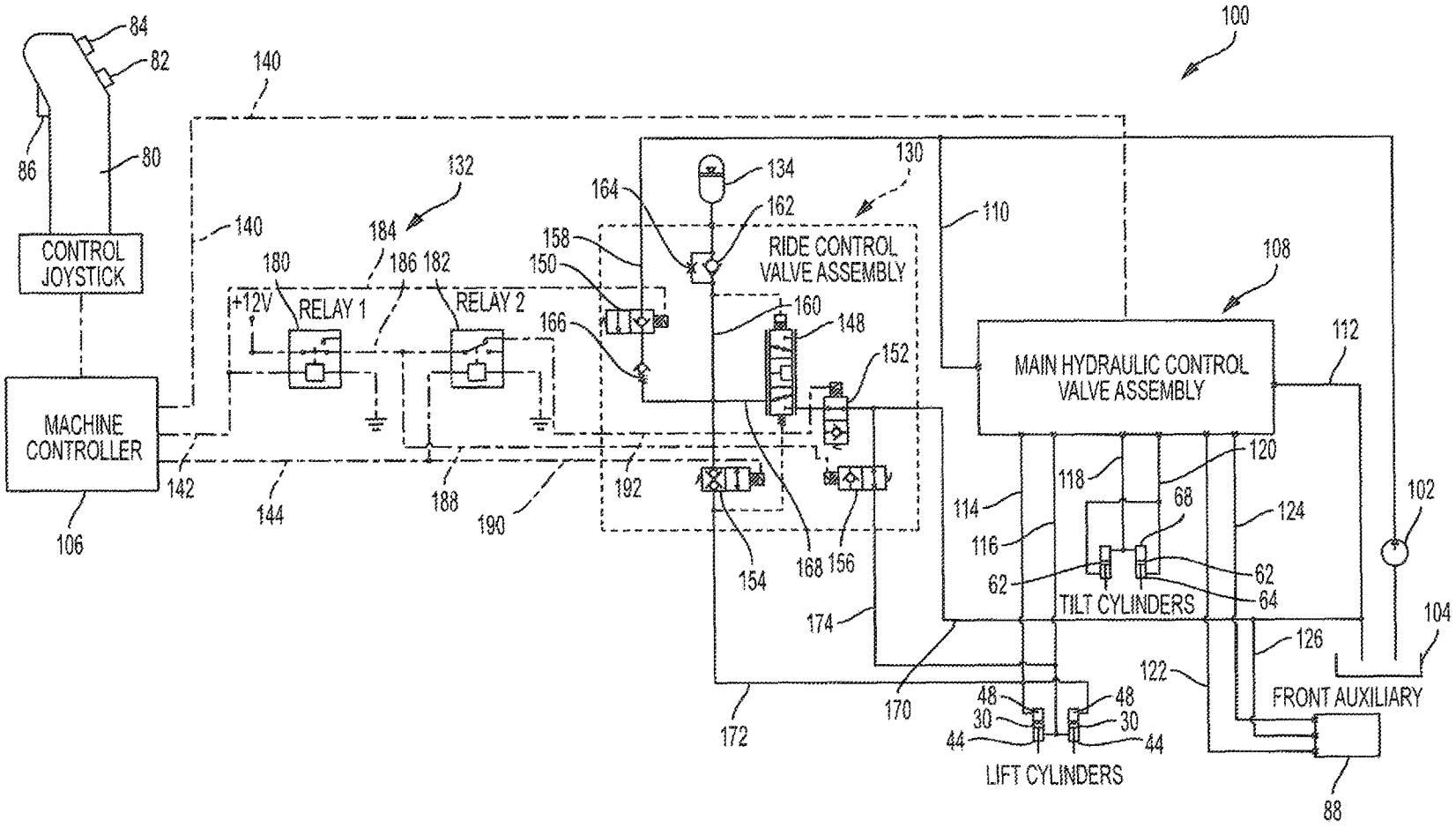

Operation of the material handling machine 10 as thus described now will described with reference to the flowchart 200 of FIG. 5 and with occasional reference to FIGS. 2-4. During standard operation in which the ride control system is deactivated, the ride control valve assembly 130 and its electronic controls 132 assume the configuration illustrated in FIG. 2. This configuration begins with Start 202 of the process 200 at initial machine start-up and continues for so long as a ride control command is not generated. As indicated by Block 204, both relays 180 and 182 remain deenergized, leaving all valves 150, 152, 154, and 156 de-energized. As a result, the cut-off valve 150 remains open to permit fluid flow into the accumulator 134 via the valve 150 and the lines 158 and 160. Backflow from the accumulator 134 is prevented by check valve 166. Since the pressure in the lines 158 and 160 varies with the operational state of the lift cylinders 30 and other machine components, the accumulator 134 will charge to the maximum pressure delivered by the pressurized fluid source (the pump 102 in this embodiment) during standard system operation, and that maximum pressure level will always be at least as high as the pressure level in the barrel ends 48 of the lift cylinders 30 at any given time. The booms 26 may be raised and lowered by control of the main hydraulic valve assembly 108 with consequent fluid flow into and out of the rod ends 44 and barrel ends 48 of the lift cylinders 30. The accumulator 134 remains isolated from the lift cylinders 30 due to closure of the valve 154, and the rod ends 44 of the lift cylinders 30 remain isolated from direct connection to the reservoir 104 due to closure of the valve 156.

Figure 5:
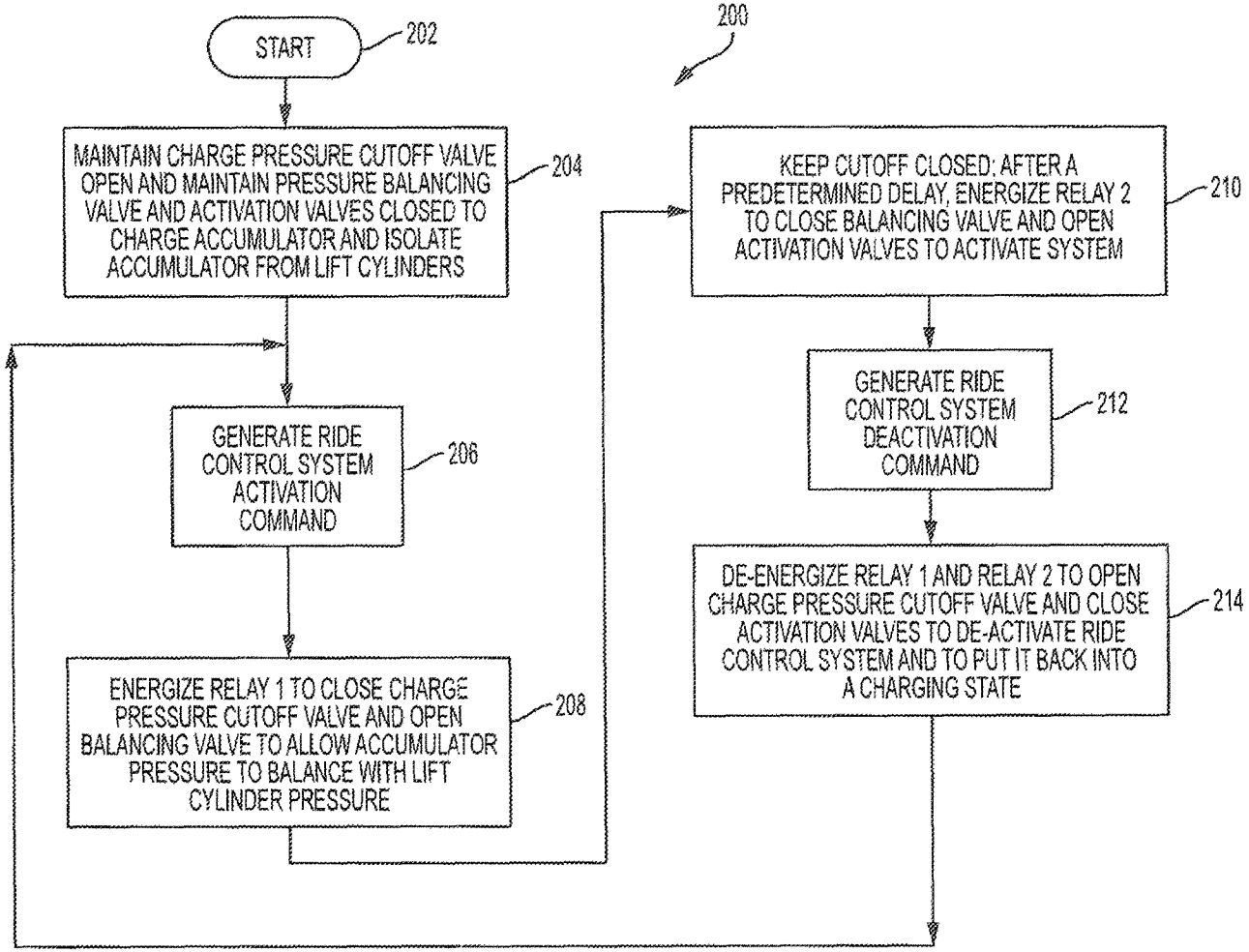
FIG. 5 is a flowchart of the operation of the ride control system of FIGS. 2-4.

At Block 206 in FIG. 5, a ride control command signal is generated by momentary action of the switch 82. The generation of this command signal initiates a transitional or balancing mode of operation shown schematically in FIG. 3 in which balancing line 142 and relay 180 are energized and activation line 144 and relay 182 remain deenergized. As result, and as seen at Block 208 in FIG. 5, the cut-off valve 150 closes to isolate the accumulator 134 from the pump 102. Closing of relay 180 opens activation valve 156 to relieve pressure in the rod ends 44 of the lift cylinders 30 to the reservoir 104. Closing of relay 180 also opens the balancing valve 152 to couple the outlet of pressure modulating valve 148 to the reservoir 104 via line 170. Pressure modulating valve 148 is operable at this time to permit fluid to flow though the valves 148 and 152 and to the reservoir 104 so long as the fluid pressure in the accumulator supply/return line 160 exceeds the fluid pressure in the lift cylinder supply/return line 172. The relay 180 remains closed for a predetermined period of time that is sufficiently long to assure the desired pressure balancing between the accumulator 134 and the lift cylinder barrel ends 48. That time period may be settable to accommodate the needs of a particular system and may be, for example, be on the order of 1-5 seconds and more typically on the order of about 2-3 seconds.

Figure 4:
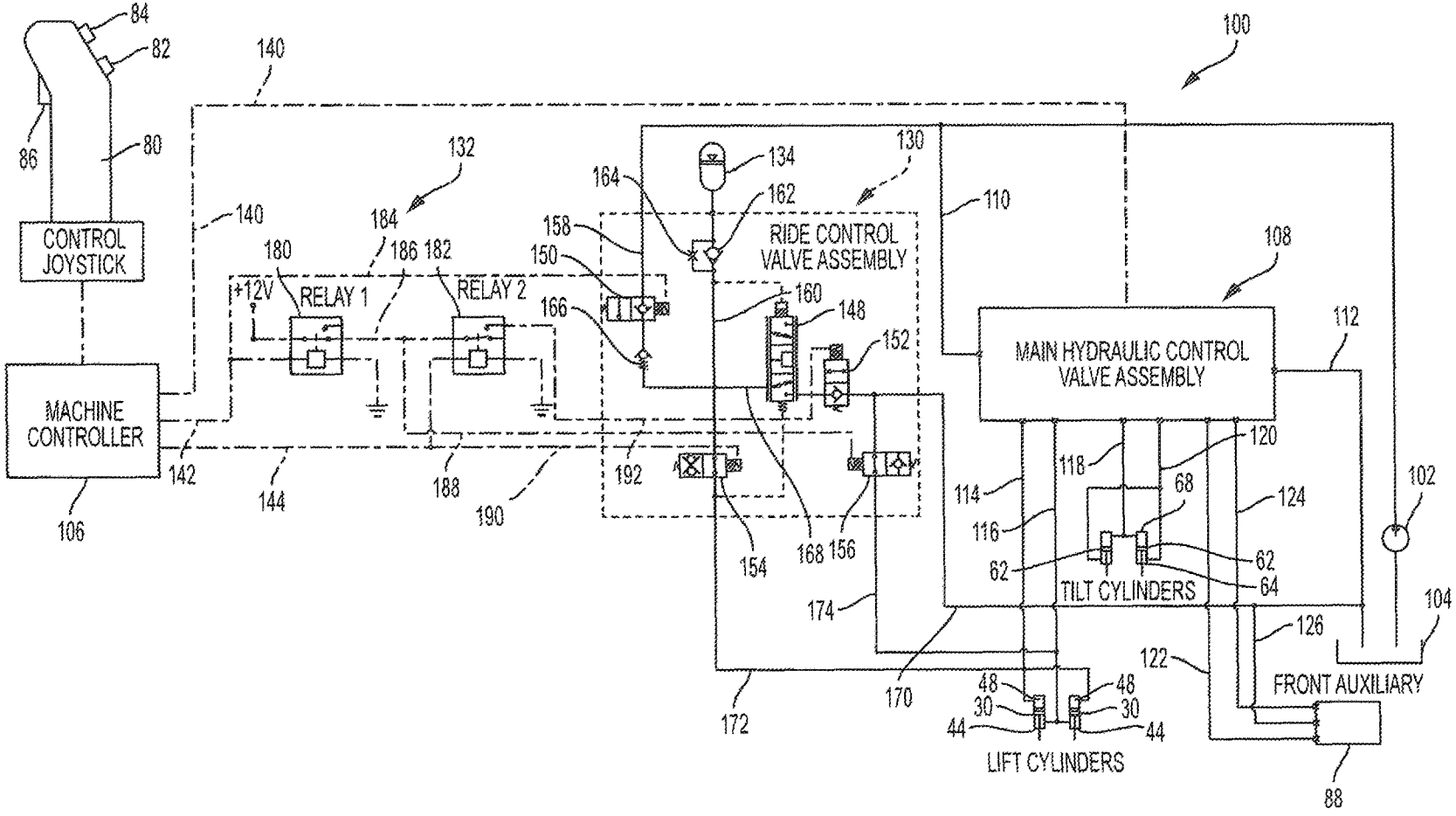

At the end of the predetermined time period, the process 200 proceeds to Block 210 to initiate the ride control mode by energizing activation line 144 and relay 182 while leaving balancing line 142 and relay 180 energized seen in FIG. 4. Valve 156 remains open due to continued closure of relay 180. Energization of the branch 190 of line 144 directly energizes the solenoid of valve 154 to open that valve, and the solenoid of balancing valve 152 is deenergized by switching of the relay 182 to isolate the line 192 and the valve 156 from the line 186 and relay 180. This step thus maintains energization of the solenoids of the cut-off valve 150 and the lift cylinder rod end drain 156 during the switch from balancing to ride control. The ride control system is now active, allowing fluid to pass between the accumulator 134 and barrel ends 48 of the boom cylinders 30 through the valve 154. Ride control system activation also allows fluid to drain from the lift cylinder rod ends 44 via the valve 156. The accumulator 134 thus provides a cushion effect to the lift cylinders 30, thus allowing lift cylinder extension and retraction relative to the chassis 12, similar to that exhibited by a shock absorber on an automotive vehicle, hence allowing machine travel over rough terrain without abrupt load carrier movement.

The ride control system is deactivated in Block 212 of the process 200 FIG. 5 by an additional press of the momentary switch 82, causing the electronic control system to deenergize both relays 180 and thus deenergize the solenoids of the valves 150, 154, and 156, thereby returning the system to the state illustrated in FIG. 2. The process 200 then returns to a state in which it awaits generation of another ride control activation command.

Figure 6:
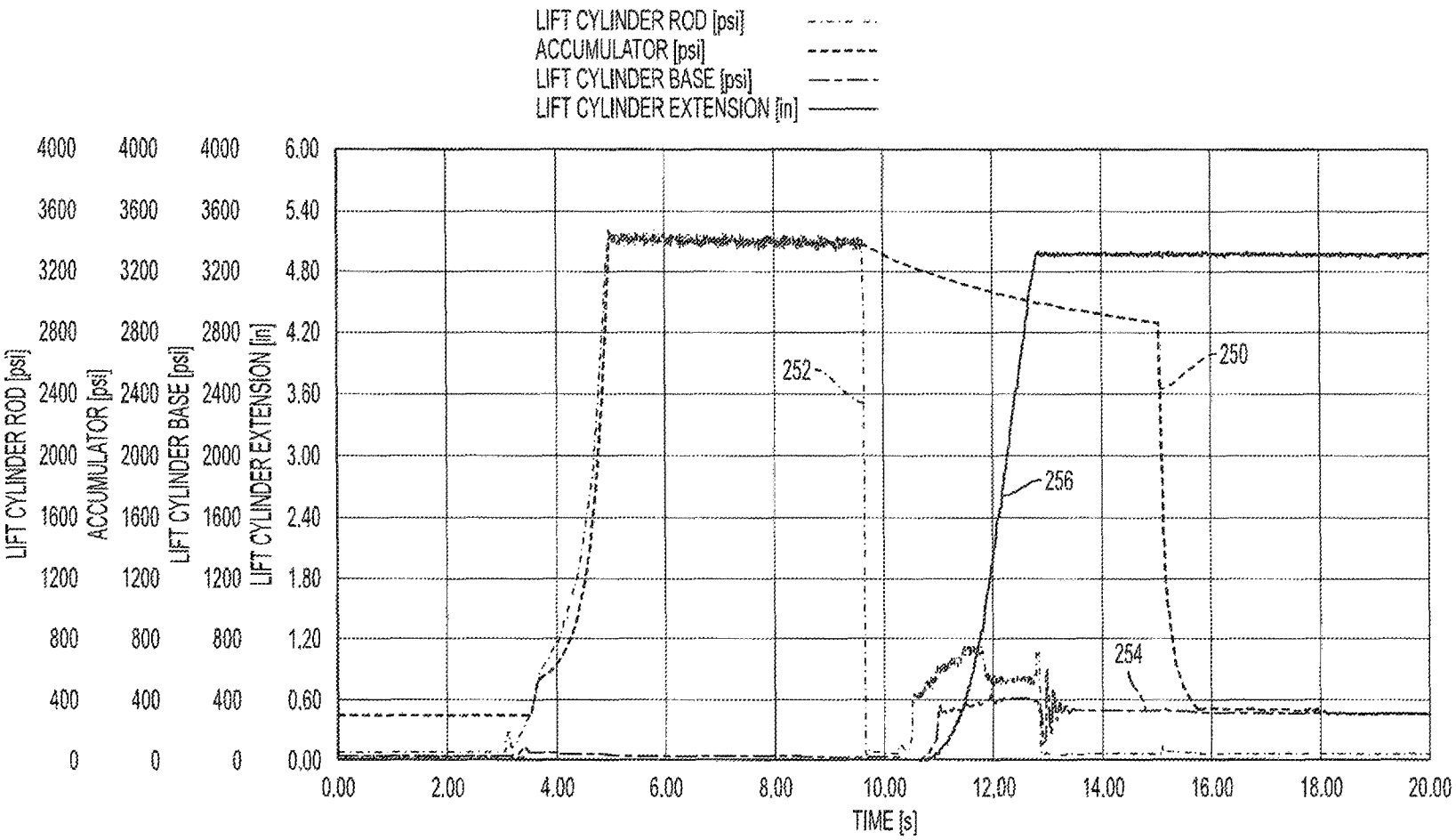
FIG. 6 is a family of curves plotting pressure in various points in the material handling machine vs. time as well as lift cylinder extension vs. time for a material handling machine equipped with the ride control system of FIGS. 2-4 and with the machine operating in an unloaded state with ride control activated during a portion of the referenced time period.
Figure 7:
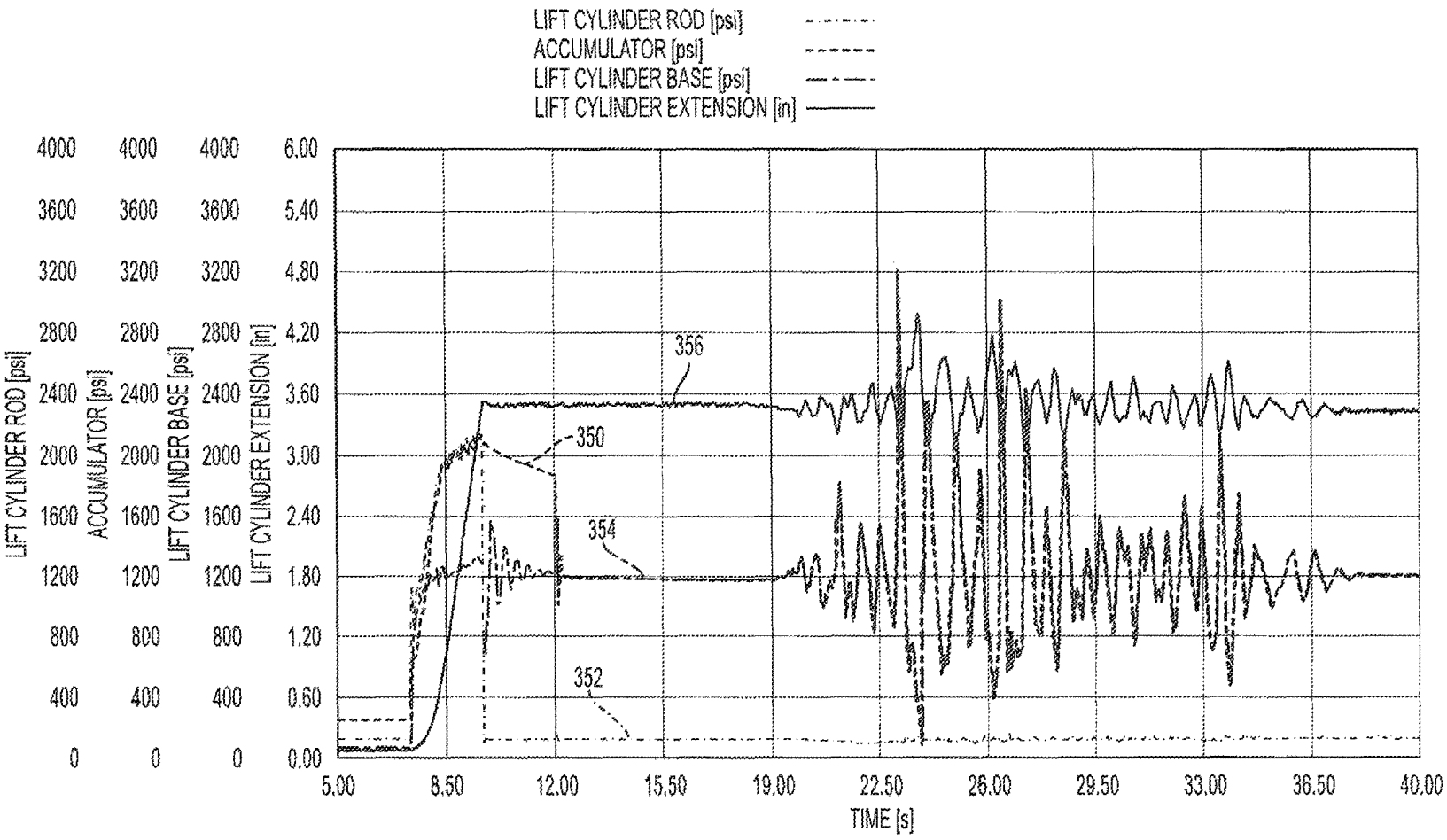
FIG. 7 is a family of curves corresponding to those of FIG. 6 but illustrating the machine operating in a loaded state.
Figure 8:
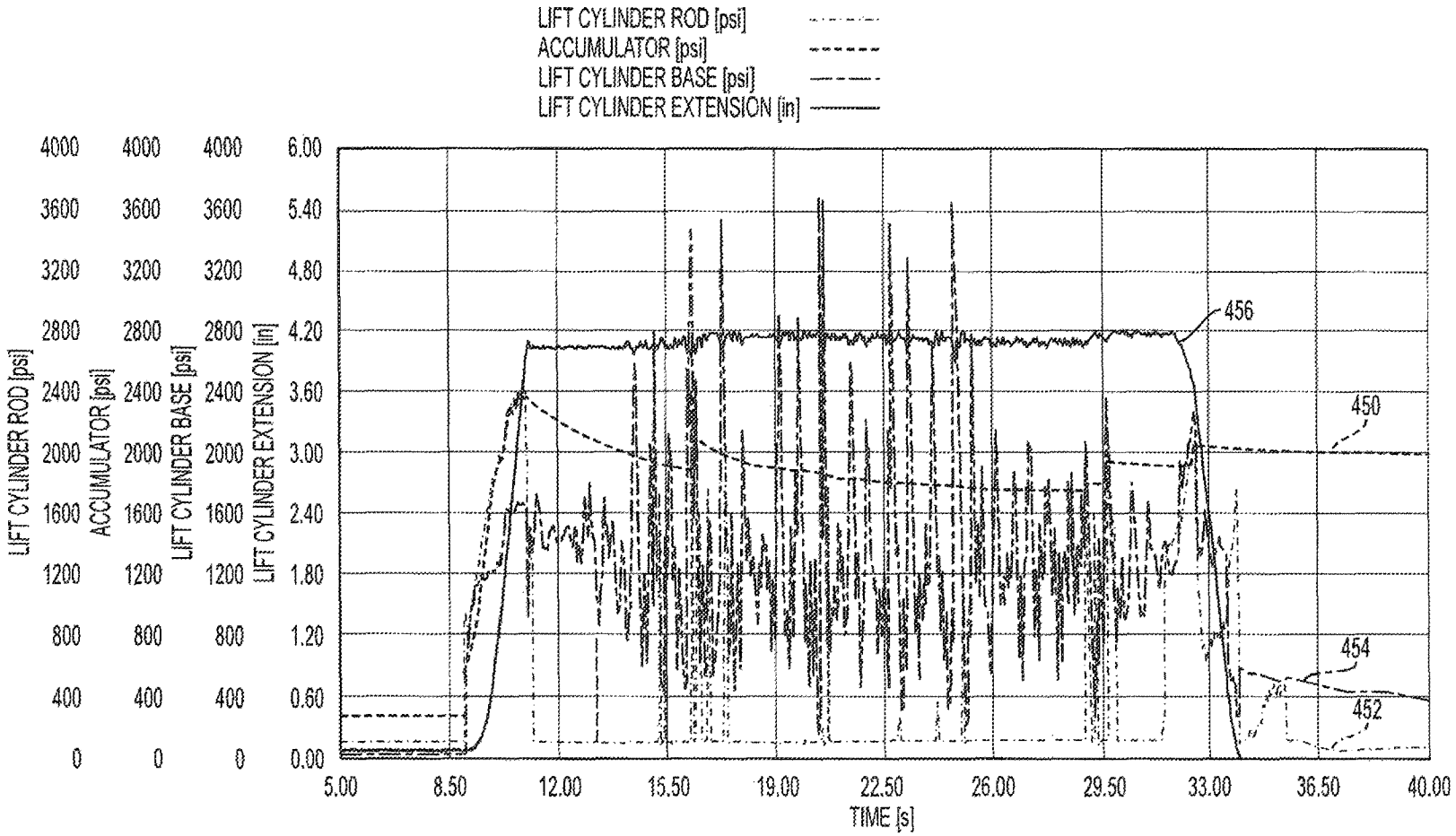
FIG. 8 is a family of curves corresponding to those of FIG. 7 but illustrating the ride control system deactivated during the entire referenced time period.

The practical effects of ride control as thus far described can be appreciated with reference to the graphs of FIGS. 6-8. Each of these graphs include a family of curves plotting pressure in various points in the material handling machine vs. time and an additional curve plotting lift cylinder extension vs. time for a material handling machine constructed as described above and equipped with the ride control system of FIGS. 2-4, with each graph representing a different set off operating conditions. The curves 250, 252, 254, and 256 of FIG. 6 plot accumulator pressure, lift cylinder rod end pressure, lift cylinder barrel end pressure, and lift cylinder extension, respectively, vs. time with the machine operating in an unloaded state. While the machine was operated in the standard mode, the boom was raised slightly to a carry position during the time period extending from 10.5 to 13 seconds with no load on the boom. Comparing curves 250 and 254, a maximum differential between the accumulator pressure and the lift cylinder barrel end pressure existed under these conditions. Ride control was activated at time 15 seconds. Note the small magnitude of the curve 254 and the large differential between curves 250 and 254 at that time, followed by a sharp accumulator pressure drop from 15 to 16 seconds as reflected by curve 250, which demonstrates operation the transitional mode of the system. The curves 250 and 254 are essentially coincident during the subsequent ride control mode of operation, demonstrating the ability of the system to equalize accumulator pressure and lift cylinder barrel end pressure prior to ride control mode activation, preventing any subsequent undesired or uncommanded movement of the boom upon ride control mode activation.

The curves 350, 352, 354, and 356 of FIG. 7 plot the same parameters when a load was raised during the period extending from 7 seconds to 9.5 seconds prior to generating a ride control command at 12 seconds. The drop in curve 350 at this time demonstrates that accumulator pressure and lift cylinder barrel end pressure equalize during the transitional mode of operation as in the first test. The machine vas then driven over rough terrain from the time period extending from 19 seconds to 38 seconds. Curves 354 and 356 indicate that lift cylinder barrel end pressure and lift cylinder movement were substantial during this operating period, indicating that the lift cylinders 30 absorbed the impacts from traveling over the rough terrain, much as a shock absorber moves up and down to absorb impacts while a vehicle travels over rough terrain.

Finally, the curves 450, 452, 454, and 456 of FIG. 8 plot the same parameters without activating the ride control system before the machine is driven over rough terrain. Curves 450 and 454 demonstrate that, after the accumulator was initially charged by about time 10 seconds, accumulator pressure remained well-above lift cylinder barrel end pressure. The machine was then driven over terrain ground from about time 14 seconds to about time 32 seconds. During that period, the relatively small fluctuations in curve 456 indicate that the lift cylinders moved very little, while the curves 452 and 454 indicate that both lift cylinder rod end pressure and barrel end cylinder pressure fluctuated wildly during that same period, demonstrating that the shocks applied to the boom were not cushioned by the hydraulic circuit.

Although the best mode contemplated by the inventors of carrying out the present invention is disclosed above, practice of the present invention is not limited thereto. It is appreciated that various additions, modifications and rearrangements of the aspects and features of the present invention may be made in addition to those described above without deviating from the spirit and scope of the underlying inventive concept. The scope of some of these changes is discussed above.

What is claimed is:

1. A material handling machine, comprising:

A. a mobile chassis;

B. a boom that is mounted on the chassis;

C. a load carrier that is mounted on the boom;

D. a lift cylinder that is connected to the boom and that is selectively actuatable to raise and lower the boom relative to the chassis; and E. an electrohydraulic control system comprising (1) a source of pressurized fluid that outputs a variable system pressure, (2) a reservoir, (3) an accumulator, (4) a ride control command generator that is operable to switch between a standard mode of system operation and a ride control mode of system operation, (5) an electronic controller that is electronically coupled to the ride control command generator, and (6) a ride control valve assembly that is electronically coupled to the electronic controller and that is fluidically coupled to the accumulator, the reservoir, the source of pressurized fluid, and the lift cylinder, wherein the electronic controller is configured to control the ride control valve assembly to fluidically couple the accumulator to the source of pressurized fluid to charge the accumulator during the standard mode of system operation and to fluidically isolate the accumulator from the source of pressurized fluid and to fluidically couple the accumulator to the lift cylinder during the ride control mode of system operation, wherein the ride control valve assembly comprises a normally open two-way/two position solenoid activated valve that is deactivated during the standard mode of system operation to permit fluid flow therethrough from the pressurized fluid source to the accumulator and that is activated during the ride control mode of system operation to prevent fluid flow therethrough from the pressurized fluid source to the accumulator.

2. The material handling system of claim 1, wherein the electrohydraulic control system is configured such that the accumulator is charged to a maximum pressure output by the pressurized fluid source during the standard mode of system operation.

3. The material handling system of claim 1, wherein the ride control valve assembly includes a first activation valve that prevents fluid flow between the accumulator and a barrel end of the lift cylinder during the standard mode of system operation and that permits fluid flow between the accumulator and the barrel end of the lift cylinder during the ride control mode of operation, and a second activation valve that prevents fluid flow from a rod end of the lift cylinder to the reservoir during the standard mode of system operation and that permits fluid flow from the rod end of the lift cylinder to the reservoir during the ride control mode of system operation.

4. The material handling system of claim 1, wherein the ride control valve assembly includes an electronically activated balancing valve, and wherein the electronic controller is configured to activate the balancing valve during a transition period occurring when switching to the ride control mode of system operation from the standard mode of system operation in a manner so as to balance the fluid pressure in the accumulator with a then-prevailing fluid pressure in the lift cylinder.

5. The material handling system of claim 4, wherein the electronic controller is configured to open the balancing valve for a predetermined period of time.

6. The material handling system of claim 4, wherein the balancing valve connects an outlet of a pressure modulating valve to the reservoir when the balancing valve is activated.

7. The material handling system of claim 1, wherein the ride control command generator includes a manually actuated switch.

8. The material handling system of claim 1, wherein the material handling machine comprises a loader and the load carrier comprises a bucket.

9. A loader comprising:

A. a mobile chassis;

B. a boom that is mounted on the chassis;

C. a bucket that is mounted on the boom;

D. a lift cylinder that is connected to the boom and that is selectively actuatable to raise and lower the boom relative to the chassis, the lift cylinder having a rod end and a barrel end; and E. an electrohydraulic control system comprising (1) a pump that outputs a variable system pressure, (2) a reservoir, (3) an accumulator, (4) a pressure-responsive pressure modulating valve, (5) a manually actuated switch, (6) an electronic controller that is electronically coupled to the switch, and (7) a ride control valve assembly that is electronically coupled to the electronic controller and that is fluidically coupled to the accumulator, the reservoir, the pump, the pressure modulating valve, and the barrel and rod ends of the lift cylinder, wherein the electronic controller is configured to be responsive to actuation of the switch to control the ride control valve assembly to switch system operation between (a) a standard operating mode in which the accumulator is fluidically coupled to the pump and is fluidically isolated from the barrel end of the lift cylinder and is charged to a maximum pressure output by the pump during system during operation in the standard operating mode, (b) a ride control mode in which the accumulator is fluidically isolated from the pump and is fluidically coupled to the barrel end of the lift cylinder, and (c) a transitional mode, occurring between the standard operating mode and the ride control mode, in which accumulator pressure is balanced with fluid pressure in the barrel end of the lift cylinder under operation of the pressure modulating valve, wherein the ride control valve assembly includes a solenoid activated balancing valve coupled to a pressure modulating valve, and wherein the electronic controller is configured to activate the balancing valve during the transition mode.

10. The loader of claim 9, wherein the electronic controller is configured to retain system operation in the transitional mode for a predetermined period of time.

11. The loader of claim 9, wherein the ride control valve assembly includes a solenoid-activated valve that is a fluid flow path connecting the pump to the accumulator, that permits fluid flow therethrough from the pump to the accumulator during the standard mode of system operation, and that prevents fluid flow therethrough from the pump to the accumulator during the ride control mode of operation.

12. The loader of claim 9, wherein the ride control valve assembly includes a first activation valve that prevents fluid flow between the accumulator and a barrel end of the lift cylinder during the standard mode of system operation and that permits fluid flow between the accumulator and the barrel end of the lift cylinder during the ride control mode of operation, and a second activation valve that prevents fluid flow from a rod end of the lift cylinder to the reservoir during the standard mode of operation and that permits fluid flow from the rod end of the lift cylinder to the reservoir during the ride control mode of operation.

13. A method of operating a material handling machine comprising:

(A) during a standard operating mode, (1) raising and lowering a boom of the material handling machine by directing fluid between hydraulic lift cylinder and a source of pressurized fluid and a reservoir, (2) charging an accumulator to a maximum pressure output by the source of pressurized fluid during the standard operating mode, and (3) fluidically isolating the accumulator from the lift cylinder; and (B) during a ride control mode, (1) fluidically isolating the accumulator from the source of pressurized fluid, and (2) permitting fluid flow between the accumulator and the lift cylinder, further comprising, during a transitional mode occurring between the standard operating mode and the ride control mode, fluidically isolating the accumulator from the source of pressurized fluid and balancing the pressure in the accumulator with a pressure in the lift cylinder, wherein the balancing step comprises activating a solenoid activated balancing valve to fluidically connect an outlet of a pressure modulating valve to the reservoir.

14. The method of claim 13, further comprising raising and lowering the boom during the ride control mode.

15. A material handling machine, comprising:

A. a mobile chassis;

B. a boom that is mounted on the chassis;

C. a load carrier that is mounted on the boom;

D. a lift cylinder that is connected to the boom and that is selectively actuatable to raise and lower the boom relative to the chassis; and E. an electrohydraulic control system comprising (1) a source of pressurized fluid that outputs a variable system pressure, (2) a reservoir, (3) an accumulator, (4) a ride control command generator that is operable to switch between a standard mode of system operation and a ride control mode of system operation, (5) an electronic controller that is electronically coupled to the ride control command generator, and (6) a ride control valve assembly that is electronically coupled to the electronic controller and that is fluidically coupled to the accumulator, the reservoir, the source of pressurized fluid, and the lift cylinder, wherein the electronic controller is configured to control the ride control valve assembly to fluidically couple the accumulator to the source of pressurized fluid to charge the accumulator during the standard mode of system operation and to fluidically isolate the accumulator from the source of pressurized fluid and to fluidically couple the accumulator to the lift cylinder during the ride control mode of system operation, wherein the ride control valve assembly includes first, second, third, and fourth solenoid actuated valves, and further comprising a balancing line directly connecting a first output of the electronic controller to the first valve and indirectly connecting the first output of the electronic controller to the second valve via a first relay, and an activation line directly connecting a second output of the electronic controller to the third valve and indirectly connecting the second output of the electronic controller to the fourth valve via a second relay.

16. The material handling machine of claim 15, wherein the first relay is a normally open relay that closes upon energization of the balancing line and the second relay is a normally closed relay that opens upon energization of the activation line.

17. The material handling machine of claim 15, wherein the first valve is in fluid communication with the pressurized fluid source and, when actuated, prevents fluid flow therethrough from the pressurized fluid source, the second valve is in fluid communication with the lift cylinder and, when actuated, prevents fluid flow therethrough from the lift cylinder, the third valve is in fluid communication with the lift cylinder and the accumulator and, when actuated, prevents fluid flow between the lift cylinder and the accumulator, and the fourth valve is in fluid communication with the lift cylinder and, when actuated, prevents fluid flow therethrough from the lift cylinder.

18. The material handling system of claim 15, wherein the ride control valve assembly includes an electronically activated balancing valve, and wherein the electronic controller is configured to activate the balancing valve during a transition period occurring when switching to the ride control mode of system operation from the standard mode of system operation in a manner so as to balance the fluid pressure in the accumulator with a then-prevailing fluid pressure in the lift cylinder, and wherein the balancing valve connects an outlet of a pressure modulating valve to the reservoir when the balancing valve is activated.

* * * * *